United States Patent [19]

Tetenborg et al.

[11] Patent Number: 4,756,142

[45] Date of Patent: Jul. 12, 1988

[54] APPARATUS FOR CLOSING FILLED SACKS

[75] Inventors: Konrad Tetenborg; Heinz Eschmann, both of Lengerich, Fed. Rep. of Germany

[73] Assignee: Windmöller & Hölscher, Lengerich, Fed. Rep. of Germany

[21] Appl. No.: 940,886

[22] Filed: Dec. 12, 1986

[30] Foreign Application Priority Data

Dec. 13, 1985 [DE] Fed. Rep. of Germany ..... 3544156
May 5, 1986 [DE] Fed. Rep. of Germany ..... 3615178

[51] Int. Cl.[4] ..... B65B 7/02
[52] U.S. Cl. ..... 53/481; 53/371
[58] Field of Search ..... 53/371, 372, 374, 376, 53/418, 481, 480

[56] References Cited

U.S. PATENT DOCUMENTS

| | | | |
|---|---|---|---|
| 1,646,397 | 10/1927 | Frank | 53/371 |
| 3,241,290 | 3/1966 | Ingleson et al. | 53/371 |
| 3,471,990 | 10/1969 | Bonuchi et al. | 53/372 |
| 3,875,726 | 4/1975 | Harris et al. | 53/481 |
| 3,990,216 | 11/1976 | Martin | 53/371 |
| 4,115,978 | 9/1978 | Langemeyer et al. | 53/570 |
| 4,580,391 | 4/1986 | Tetenborg et al. | 53/371 |

FOREIGN PATENT DOCUMENTS

| | | | |
|---|---|---|---|
| 1948229 | 4/1971 | Fed. Rep. of Germany | 53/372 |
| 2038763 | 7/1980 | United Kingdom | 53/371 |

*Primary Examiner*—Robert L. Spruill
*Assistant Examiner*—Steven P. Weihrouch
*Attorney, Agent, or Firm*—Fleit, Jacobson, Cohn & Price

[57] ABSTRACT

Apparatus for closing filled sacks, which have been transferred from a filling station to a take-over station and a closing station by a conveyor comprising a gripper, which like pliers grips the flattened lips of the filled sacks. A pair of gripping rollers, which are rotatable about axes which are at right angles to the main axis of the sack, take-over the sacks at the take-over station with the lips protruding. The apparatus also comprises a welding or sewing machine to act on the protruding lips to form a seam for closing the filled sacks. At least one of the gripping rollers is rotated as the filled sacks are conveyed to the closing machine to force the lips to protrude sufficiently to facilitate making the closing seam.

16 Claims, 5 Drawing Sheets

APPARATUS FOR CLOSING FILLED SACKS

BACKGROUND OF THE INVENTION

1. Field of the Invention

This invention relates to apparatus for closing filled sacks, which have been transferred by a conveyor from a filling station to a closing station, comprising a gripper, which, like pliers, grips the opening-defining edges of the filled sacks and presents them to a pair of gripping rollers, rotatable about axes at right angles to the main long axis of the sack. The apparatus also comprises closing means, which are located adjacent the gripper and serve to form a seam for closing the opening-defining edge portions of the sack which are being held in flat surface contact with each other.

2. Description of the Prior Art

In related apparatus which is known from Austrian Patent Specification No. 363,851, the closing means consist of pivoted welding jaws, which cooperate like pliers and form a top seam weld for closing the opening-defining edges, the marginal portions of which are in flat surface contact with each other. The two welding jaws are carried by respective arms and a U-shaped member is pivoted to each of said arms and carries a pressure-applying roller. As the welding jaws approach their welding position the pressure-applying roller is pivotally moved against the action of a spring from a position in which the roller is remote from the welding jaw to a position in which the roller is adjacent to the welding jaw so that the roller moving between said two positions squeezes air out of the sack and moves the gaping edge portions which define the opening into a closed position with the edge portions in contact with each other and holds them closed in that position until they are contacted by the welding jaws.

German Patent Specification No. 26 29 065 and the corresponding U.S. Pat. No. 4,115,978 granted on an application filed June 24, 1977, disclose an apparatus for closing filled sacks. That apparatus comprises a drum-like feeder, which rotates about a horizontal axis and is provided with four pairs of plier-like grippers, which are distributed around the periphery of the drum. When the sacks have been filled and the opening-defining edge portions have been pulled together to a flat shape, the feeder deposits the filled sacks on a belt conveyor in such a manner that, in the deposited sacks, the closed lips which are formed by the opening-defining edge portions, protrude beyond the grippers and assume a horizontal position so that said closed lips can be provided between the jaws of a welding apparatus that makes a transverse seam weld closing the sacks. That known apparatus can be used to close the flattened transverse opening-defining edge portions of plastic sacks or plastic-coated sacks by means of transverse seam welds if the lips or borders formed by the superimposed edge portions which define the opening of the sack protrude beyond the grippers to a sufficiently large extent. But difficulties arise if the lips are too short or of insufficient width or if the sacks are to be closed by stitched seams which requires longer or wider lips, borders or margins.

SUMMARY OF THE INVENTION

It is an object of the invention to provide an apparatus which is of the kind described above and which is adapted to form or close the superimposed opening-defining edge portions into lips or margins which are sufficiently long or wide to enable seam welds and particularly also stitched seams even through the grippers that hold the sacks as they are filled do not of themselves permit formation of sufficiently wide or long lips and/or an immediately succeeding closing of the sacks by seam welds or stitched seams.

According to the invention, that object is accomplished by providing a pair of gripping rollers to receive filled sacks from the plier-like grippers with at least one of the gripping rollers adapted to be driven. In the apparatus in accordance with the invention the opening-defining edge portions of the filled sacks are clamped in position between the gripping rollers, which serve as a pair of feed rollers, having taken over the superimposed opening-defining edge portions from the grippers which hold the sacks as they are filled. The gripping rollers are arranged in a carriage and move from the sack take-over station to a closing station. At the closing station or during the movement to the closing station, a means for driving the pair of gripping rollers are operated so that the superimposed opening-defining edge portions protrude sufficiently beyond the pair of gripping rollers to form lips or margins which are so long or wide that a transverse seam weld or, if desired, a stitched seam can be formed therein. The apparatus in accordance with the invention produces lips so long that they can be backfolded or rolled up before a stitched seam is formed therein.

The gripping rollers are suitably mounted on a carriage, which is movable in the main frame on tracks parallel to the conveyor transporting the filled sacks and drive means are provided for the gripping rollers to drive at least one of them to advance the gripped lips a predetermined amount or extent through them so that the lips protrude a sufficient extent. The conveyor may be of the endless type or may be in the form of a carousel.

The contact surface of both gripping rollers may be made of elastic material, but at least one of the gripping rollers is made elastic through the use of any suitable material so that the gripping rollers will not be blocked or interfered with by sack contents, such as granular material, which is disposed or lies between the flattened opening-defining edge portions or between one of the edge portions and one of the gripping rollers.

At least one gripping roller may comprise axial portions which differ in diameter in dependence on the cross-section of the flattened lips which are to be protruded. For instance, in the handling of gusseted sacks, the sides or lateral portions of the sack are slightly thicker than the middle due to the gussets. Therefore, it is desirable to provide a corresponding stepping of the diameters of the axial portions of at least one gripping roller so that the flattened opening-defining edge portions will be uniformly compressed throughout their length.

At least one of the two gripping rollers may consist of axially spaced apart sections, which are coaxially mounted and aligned and engage the opening-defining edge portion only on the side or lateral edge portions of the sack.

According to one feature of the invention, one of the gripping rollers is free-wheeling but in one direction only and is prevented from a reverse rotation. Such free-wheeling will ensure that the upwardly protruding flattened lips or edge portion of the sack will advance to protrude but will not be pulled down owing to the stress or weight of the material in the sack or otherwise.

To permit gripping rollers to take over or receive the flattened lips formed by the closure of the opening-defining edge portions, when they are in flat surface contact with each other and lying in a horizontal plane due to the plier-like grippers, the axes of the gripping rollers may be vertically spaced apart in a vertical plane and means are provided for pivotally moving the gripping rollers into a horizontal plane when advanced or moved to be located below the closing station.

In a preferred embodiment of the invention, the gripping roller of the pair, which is the lower roller in the take-over position, is rotatably mounted in the carriage and the upper gripping roller is freely rotatably mounted in a sub-frame, which is pivoted about the axis of the lower gripping roller. A lever is clamped to the shaft of the lower gripping roller and is connected to the frame of the apparatus by a link in such a manner that the flattened lips which are formed by the opening-defining edge portions and clamped between the gripping rollers will be advanced through the gripping rollers to protrude more due to the lower gripping roller being driven as the carriage travels from the take-over position to the welding or sewing position. The upper gripping roller is adapted to be lifted and lowered in guide slots formed in the legs of the sub-frame by fluid-operable piston-cylinder units and to be urged against the lower gripping roller The sub-frame is interconnected to the main frame through a linkage that operates to pivot the sub-frame to a horizontal position, as the sub-frame is moved together with the carriage from the take-over position (receiving station) to the welding or sewing position (closing station).

DETAILED DESCRIPTION OF THE PREFERRED EMBODIMENTS

Figure 1:
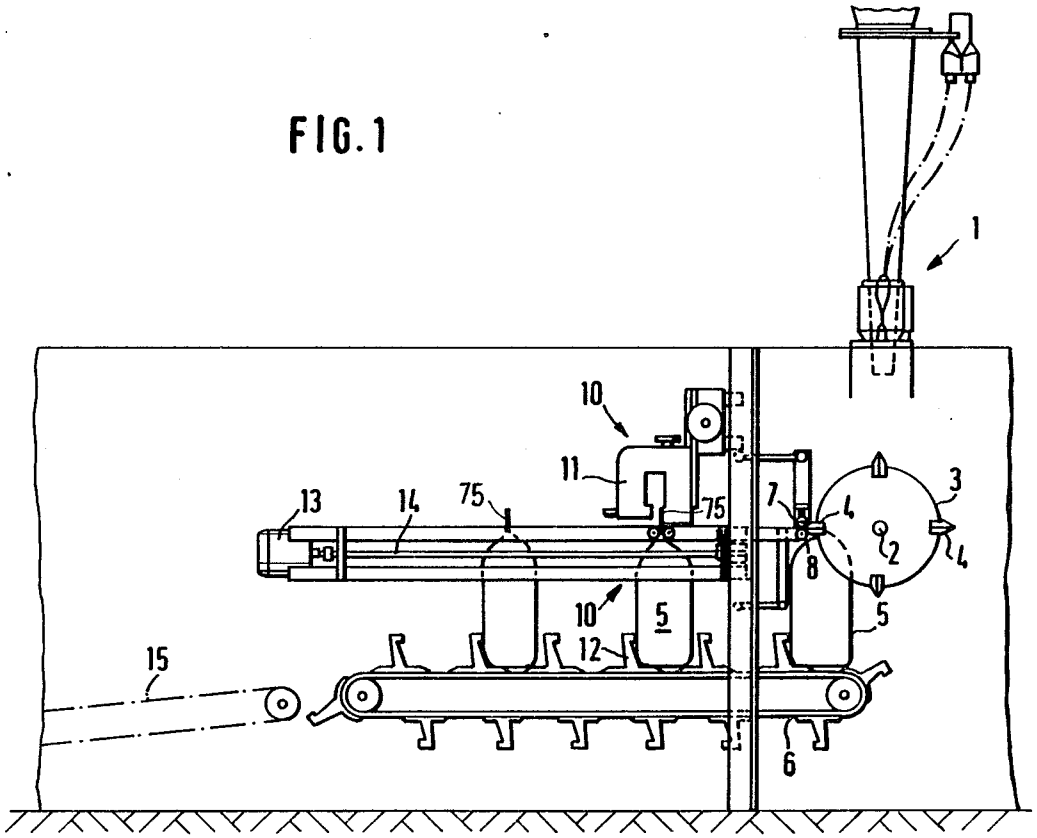
FIG. 1 is a side elevation showing the apparatus of the invention comprising a transversely movable sewing machine for providing stitched seams for closing the flattened lips formed from the opening-defining edge portions of the filled sacks.

Illustrative embodiments of the invention will now be explained in more detail with reference to the drawing.

FIG. 1 shows a filling station 1 and a drum-like feeder 3, which is rotatable about a transverse horizontal axis 2. The drum-like feeder 3 comprises four pairs of plier-like grippers 4, which are spaced around the periphery and are designed as described in U.S. Pat. No. 4,115,978 which description is here incorporated by reference.

The plier-like grippers 4 which are arranged in pairs on the sides of the drum-like feeder 3 deposit filled sacks 5 on the receiving end of an endless belt conveyor 6 in such a manner that the flattened opening-defining edge portions or lips 75 are held in a horizontal orientation by the grippers 4 with the lips protruding or pointing to the left as viewed in FIG. 1. In that position of the sack 5, gripping rollers 7, 8 which constitute the gripping mechanism to take-over from the grippers 4 and move with sack 5 to the closing station, receive the flattened opening-defining edpge portions or lips 75 and clamp said edge portions or lips 75 between them. A carriage which carries the gripping rollers 7, 8 is then moved from the take-over station to the sewing position 10 as the sack 5 is being transported on the belt conveyor 6. During that movement the gripping rollers 7, 8 are pivotally moved in unison about the axis of the lower roller 7 so that the flattened opening-defining edge portions or lips 75 assume the illustrated vertical position when the sewing position 10 has been reached. During that transport, the lower gripping roller 7 performs a rotation so that the two gripping rollers 7, 8, act as a pair of feed rollers to move the flattened opening-defining edges or lips 75 through the rollers 7, 8 to such an extent that the portion of the lips 75 that are protruding have a sufficient length to enable sewing machine 11 at closing station 10 to be operated to make a seam that closes the opening-defining edge portions or lips 75. For this purpose, the opening-defining edge portions or lips 75 may be backfolded or rolled up and the stitched seam may be formed in the reversely folded or rolled up portion.

As is illustrated, the belt conveyor 6 is provided with U-shaped retaining members 12, which support the sacks 5 and hold them in a vertical position as they are transported. The carriage 16 on which the gripping rollers 7, 8 are mounted is movable on track rails 19 in synchronism with the sacks 5 from the sack-depositing position (take-over station) to a sewing position (closing station 10). A screw 14, which is driven by motor 13, is provided to move the carriage 16. When the sacks 5 have been closed by the stitched seams they are transferred from the delivery end of conveyor 6 onto the succeeding belt conveyor 15 and are carried away by the latter.

The carriage 16, in which the gripping rollers 7, 8 are mounted, will now be explained in more detail with reference to FIGS. 3 and 4. The carriage 16 comprises a sub-frame 17, which is composed of beams assembled in a triangular configuration, and is connected by carrying plates 18 to slide bushings, not shown, which are slidably mounted and guided on vertically spaced parallel track rods 19 in a conventional manner.

Horizontal crossbeam 20 of the sub-frame 17 has forked end portions, which are connected by screws to bearing plates 21. The latter are formed with bearing bores, in which the journals 22 of the gripping roller 7 are rotatably mounted. The legs 23 of a U-shaped sub-frame 24 are mounted on the outer end portions of the journals 22 so that the sub-frame 24 is pivotally movable about the longitudinal axis of the gripping roller 7. The legs 23 of the U-shaped sub-frame 24 are formed with slots 25, in which journals 26 of the upper gripping roller 8 are slidably guided. The journals 26 are connected to or engaged by the piston rods 27 of pneumatic cylinders 28, which are secured in the U-shaped sub-frame 24 as shown and are operable to move the gripping roller 8 into and out of engagement with the gripping roller 7. The gripping roller 8 is comprised of a cylindrical shell which is bearing mounted on journals 26 to be freely rotatable relative to the journals 26, which, as mentioned, are connected to the piston rods 27. In a modification of the invention, a ratchet or pawl or like mechanism is included in roller 8 in a conventional way to allow rotation in one sense only, that is to advance lips 75 out of rollers 7, 8.

The angled upper arm 30 of a bell-crank lever 31 is clamped to the journal 22 of the lower gripping roller 7. The bell-crank lever 31 is pivoted at the lower free end of its longer arm by a hinge 33 to link 34, which is pivoted through pin 36 in the machine frame 39 by the hinge 35. The shorter arm 30 of the bell-crank lever 31 is apparent from the top plan view in FIG. 4. The depending longer arm of the bell-crank lever 31 is shown in cross-section in FIG. 4 by a solid line and a broken line. The hinge 33 is indicated only in phantom in FIG. 4.

Figure 4:
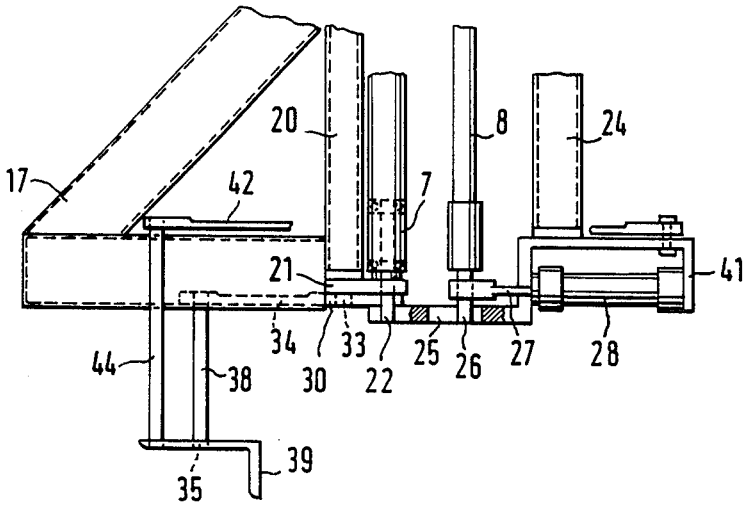
FIG. 4 is an enlarged fragmentary view showing the shiftable gripper.

As is indicated in FIG. 4, the link 34 is pivoted or hinged to the end of a pin 36, which is secured to the vertical angle section member 39 of the main frame.

The U-shaped sub-frame 24, which pivots on the journals 22 of the lower gripping roller 7, is provided with U-shaped brackets 40, 41, for mounting the hydraulic cylinders 28. Another link 42 is provided at one end to the outer end of the bracket 41 and is pivoted at its other end to the pin 44, which is also secured to the vertical section member 39 of the main frame.

Figure 2:
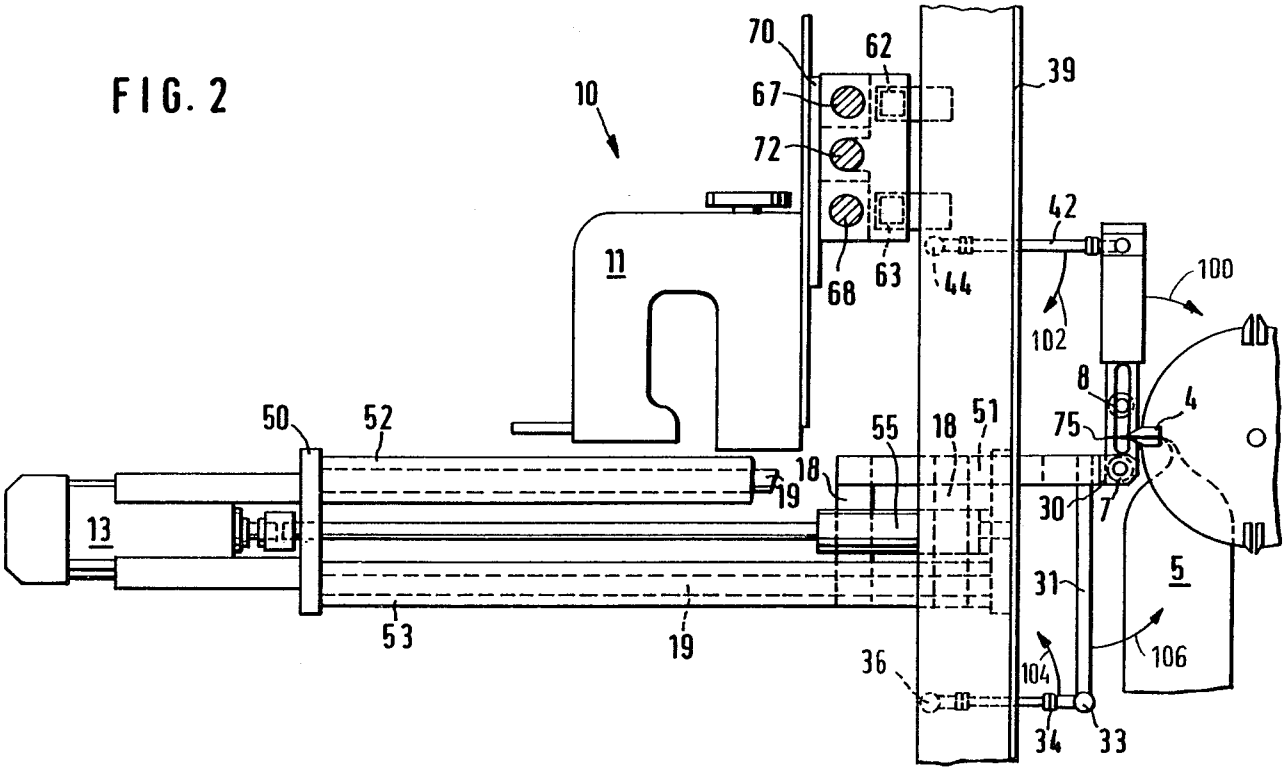
FIG. 2 is an enlarged side elevation showing the inventive apparatus of FIG. 1.

The lengths of the links 34, 42, the locations of the pivots connecting said links to the vertical frame section member 39 via pins 36, 44, respectively, the location of the pivot connecting the link 42 to the bracket 41 carried by the sub-frame 24, and the lengths of the arms of the bell-crank lever 31 are so selected that during a movement of the carriage 16 from the take-over station, the right-hand or receiving position shown in FIGS. 1 and 2, to the closing station 10, the sewing position shown in FIG. 1, the U-shaped sub-frame 24 is pivotally moved clockwise, as viewed in FIG. 2 (see arrow 100), from its vertical position to a horizontal position and the opening-defining edge portions or lips 75 are pulled ahead or advanced by the gripping roller 7 being rotated by bell-crank lever 31 to move lips 75 through gripping rollers 7, 8 by a predetermined and desired length, distance, amount or extent. According to the invention, it will be apparent that two linkages are provided consisting each of a link and a lever. In one case, the linkage is constituted by the link 42 and the sub-frame 24 and in the other by the link 34 and the bell-crank lever 31. Both linkages are connected to the carriage 16 and move in response to the carriage 16 being moved along lead screw 14 and rails 19 from the take-over station to the closing station 10. During this movement of carriage 16, the sub-frame 24 is pivotally moved between its vertical and horizontal positions with link 42 pivoting clockwise as viewed in FIG. 2 (see arrow 102), and sub-frame 24 likewise pivoting clockwise as viewed in FIG. 2 (see arrow 100), to move effectively gripping roller 8 into the horizontal plane of gripping roller 7 and in a trailing position. At this time, the lips 75 have been moved from the horizontal to project vertically upward. During this movement of carriage 16, the required rotation for pulling the flattened opening-defining edge portions or lips 75 is imparted to the lower gripping roller 7. As carriage 16 moves left as viewed in FIG. 2, link 34 and bell-crank 31 each pivot counterclockwise as viewed in FIG. 2, (see arrows 104 and 106, respectively), and short arm 30 of bell-crank 31 drives or causes journal 22 and roller 7 to likewise experience a counterclockwise rotation, as viewed in FIG. 2, pulling sack 5 into the gripping rollers 7, 8 and advancing lips 75 out of the gripping rollers 7, 8 so that a greater margin of flattened lips 75 will be available to be worked on by the closure mechanism, in this case, sewing machine 11. The drive for or actuation of each linkage is derived directly from the translatory movement of the carriage 16.

As has been stated above, the carriage 16 is adapted to be shifted along the guide rods 19, on which the carriage is mounted in a conventional way by means of bushings, now shown, as has been stated hereinbefore. The guide rods 19 are vertically spaced and parallel to the belt conveyor 6 and are secured at their ends to mounting plates 50, 51, which are interconnected by section beams 52, 53, which are parallel to the guide rods. The sectional beams or members 52, 53 and, if desired, also the mounting plate 51, are connected to the vertical section member 39 of the main frame. The screw 14 is rotatably mounted in the mounting plate 50 and is in screw-threaded engagement with a nut 55, which is secured to the carriage 16, e.g., by being secured to mounting plates 18. The motor 13 for driving the screw 14 is flanged to the mounting plate 50 and supported by and fixed to plates 56 attached to mounting plate 50. The motor 13 is controlled by conventional means to move the carriage 16 from the receiving station to the sewing station in synchronism with the movement of the belt conveyor 6.

Figure 3:
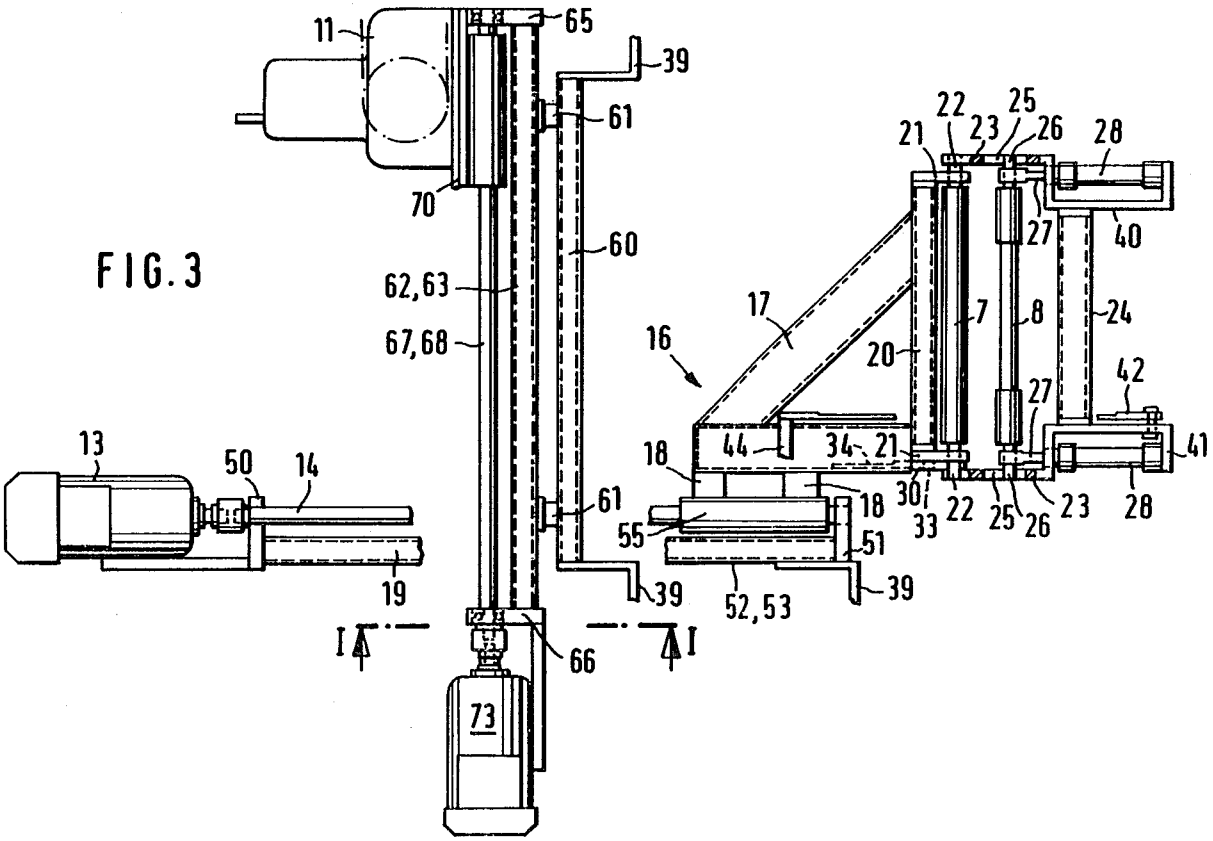
FIG. 3 is a partly exploded top plan view showing the apparatus of FIG. 2.

A crossbeam 60 is secured to vertical section members 39 of the main frame in the manner shown in FIG. 3 and is provided with brackets 61, which carry vertically spaced section members 62, 63. The end portions of the section members 62, 63 are connected to leg-like mounting plates 65, 66. Spaced apart, vertically spaced parallel track rods 67, 68 are secured to and extend between the mounting plates 65, 66. The sewing machine 11 of known construction is carried by a carriage 70, which is slidably mounted on and movable on said track rods 67, 68 and is guided on the track rods 67, 68 in a conventional way by bushings, not shown. A screw 72, shown in FIG. 2, is bearing mounted in mounted plates 65, 66 and is in screw-threaded engagement with a nut 74, which is provided on and fixed to the carriage 70. The screw 72 is driven by a motor 73, which is flanged to and fixed on the mounting plate 66. The sewing machine 11 is mounted on and secured to the carriage 70 and thus, is movable by the screw 71 transversely to the belt conveyor 6 so that the stitched seam can be made and provided in the opening-defining edge portions or lips 75, which are held in the sewing position by the gripping rollers 7, 8, namely, protruding vertically above rollers 7, 8 a sufficient distance to enable the stitched seam to be made.

The main frame components, except for vertical beams 39 shown in an exploded view of FIG. 3, are not otherwise shown but consist of conventional structural members interconnected in a conventional way as will be readily apparent to one of ordinary skill in the art.

In FIG. 2, the sack 5 is shown immediately after it has been placed on the belt conveyor 6 (not illustrated in this Figure) and the gripping rollers 7, 8 are in their initial or starting position still spaced apart from the lips 75, which are protruding from the grippers 4 in a horizontal plane with the lips 75 lying in part in the vertical plane of the rollers 7, 8.

Figure 1A:
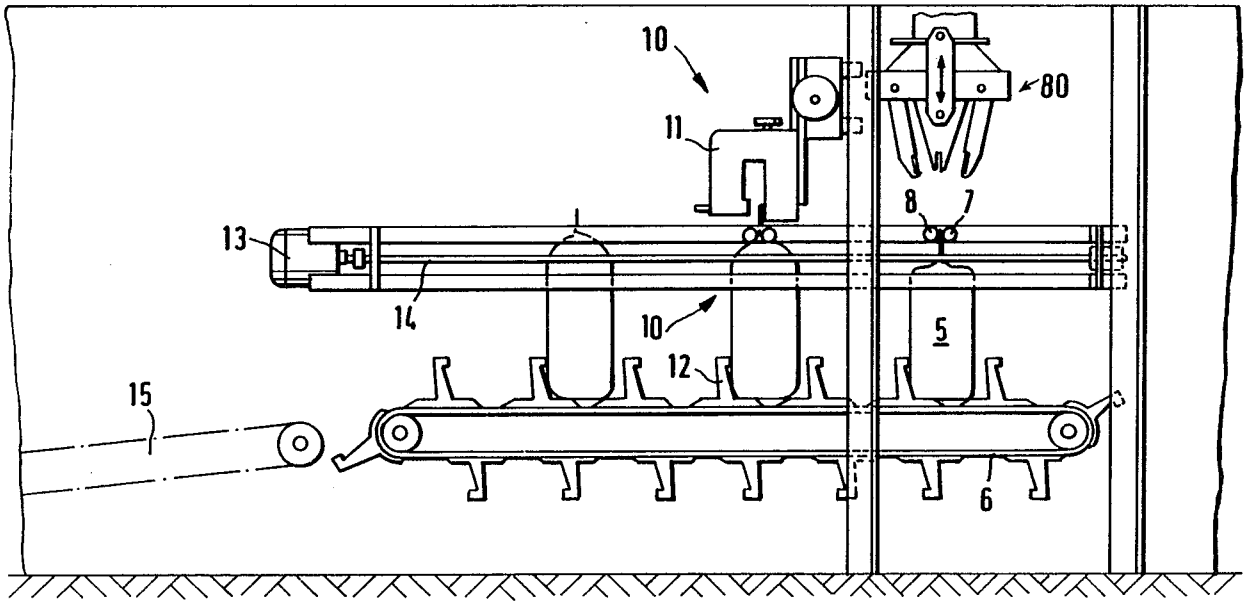
FIG. 1*a* is a diagrammatic side elevation showing a second embodiment of the inventive apparatus.

In the alternative embodiment shown in FIG. 1*a*, the sack 5 which has been filled conventionally by a known filling apparatus 80 is deposited on the belt conveyor 6 by known gripping or holding means, not shown. The pair of gripping rollers 7, 8 are moved together bearing against each other, by means which are not shown, but which may comprise means as described previously, so that the vertically extending flattened edge portions or lips 75 of the filled sack 5 are clamped by the rollers 7, 8. As the gripping rollers 7, 8 move toward the sewing machine 11, a link and lever like link 34 and bell-crank 31 act to drive rollers 7 or 8 in a direction to advance or pull the flattened lips 75 vertically to protrude above the rollers 7, 8 to such an extent that said edge portions or lips 75 can be closed by a stitched seam even when they have been backfolded once or more times.

In the alternative embodiment shown in FIG. 1*a*, the gripping rollers 7, 8 are mounted in a carriage, not shown, but like carriage 16 which is movable on a track, like rods 19, and is driven to move in synchronism with the belt conveyor 6 by known control means. Motor 13 and lead screw 14 are shown. The components not visible in FIG. 1a are like those previously described.

Although the present invention has been shown and described with respect to specific embodiments, various changes and modifications will be evident to those skilled in the art. Such changes and modifications are deemed to come within the purview of the present inventive concepts as expressed by the claims when considered with equivalents.

What is claimed is:

1. Apparatus for closing filled sacks, which have been transferred from a filling station to a closing station during which transfer the opening-defining edges of the filled sacks have been flattened together and held by gripper means comprising gripping roller means including a pair of rollers rotatably mounted about axes which are at right angles to the main axis of the sack for receiving and clamping said opening-defining edges when released by the gripper means in a take-over position, moving means for moving the sack and gripping roller means from a first point at which said gripping roller means receives said flattened opening-defining edges to a second point where said flattened opening-defining edges are to be closed, closure means located at said second point to form a seam for closing the opening-defining edges of the sack, and operative means associated with the moving means for rotating at least one of the rollers of the gripping roller means responsive to movement of the moving means between said points to advance the gripped opening-defining edges out of the rollers a predetermined amount to present a greater margin at said second point for said closure means to act on.

2. Apparatus according to claim 1 further comprising said moving means including a conveyor for moving the sack and carriage means movable on tracks arranged parallel to the conveyor, and the gripping roller means are mounted in the carriage.

3. Apparatus according to claim 1 wherein at least one roller has an elastic peripheral surface.

4. Apparatus according to claim 1 wherein at least one roller comprises a surface profile including axial portions which differ in diameter in dependence on the cross-section of the flattened opening-defining edges to be advanced out of the rollers.

5. Apparatus according to claim 1 wherein at least one roller comprises axially spaced sections which engage the flattened opening-defining edges only on the lateral edge portions of the sack.

6. Apparatus according to claim 1 wherein one roller is free wheeling.

7. Apparatus according to claim 1 wherein one roller is provided with free-wheel for preventing a reverse rotation of the roller.

8. Apparatus according to claim 1 wherein the rollers of said gripping roller means initially are in vertically spaced relation, clamping means are provided to clamp the rollers together with the flattened opening-defining edges clamped there between and a second operative means is provided to pivot the upper roller about the axis of the lower roller into a common horizontal plane as the gripping roller means is moved to the second point.

9. Apparatus according to claim 8 wherein the moving means includes a carriage means in which the gripper roller means is mounted with the pair of rollers arranged vertically spaced, the lower roller in the take-over position being rotatably mounted in the carriage and the upper roller being freely rotatably mounted in a sub-frame which is pivoted about the axis of the lower roller, and the operative means includes lever means clamped to the shaft of the lower roller and connected to a stationary point in such a manner that the lower roller will be rotated as the carriage means moves to the second point.

10. Apparatus according to claim 9 wherein the upper roller is adapted to be lifted and lowered in guide slots formed in legs of the sub-frame and to be urged against the lower roller by fluid-operable piston-cylinder means, and the sub-frame is connected to a stationary point by link means in such a manner that the sub-frame is pivotally moved to a horizontal position as the sub-frame is moved together with the carriage means to the second point.

11. Apparatus for closing filled sacks, which have been transferred from a filing station to a closing station during which transfer the opening-defining edges of the filled sacks have been flatened together and held by gripper means comprising gripping roller means including a pair of rollers rotatably mounted about axes which are at right angles to the main axis of the sack for receiving and clamping said opening-defining edges when released by the gripper means in a take-over position, moving means for moving the sack and gripping roller means from the point at which said gripping roller means receives said flattened opening-defining edges to a second point where said flattened opening-defining edges are to be closed, closure means located at said second point to form a seam for closing the opening-defining edges of the sack, and operative means actuated responsive to moving said gripping roller means to cause rotation of at least one of the rollers of the gripping roller means to advance the gripped opening-defining edges out of the rollers a predetermined amount to present a greater margin at said second point for said closure means to act on wherein the rollers of said gripping roller means initially are in vertically spaced relation, clamping means are provided to clamp the rollers together with the flattened opening-defining edges clamped there between and a second operative means is provided to pivot the upper roller about the axis of the lower roller into a common horizontal plane as the gripping roller means is moved to the second point.

12. Apparatus according to claim 11 wherein the moving means includes a carriage means in which the gripper roller means is mounted with the pair of rollers arranged vertically spaced, the lower roller in the take-over position being rotatably mounted in the carriage and the upper roller being freely rotatably mounted in a sub-frame which is pivoted about the axis of the lower roller, and the operative means includes lever means clamped to the shaft of the lower roller and connected to a stationary point in such a manner that the lower roller will be rotated as the carriage means moves to the second point.

13. Apparatus according to claim 12 wherein the upper roller is adapted to be lifted and lowered in guide slots formed in legs of the sub-frame and to be urged against the lower roller by fluid-operable piston-cylinder means, and the sub-frame is connected to a stationary point by link means in such a manner that the sub-frame is pivotally moved to a horizontal position as the sub-frame is moved together with the carriage means to the second point.

14. A method of closing filled sacks having opening-defining edges comprising the steps of:

(a) delivering to a take-over position filled sacks with the opening-defining edges flattened together;

(b) taking over the filled sacks by clamping the flattened opening-defining edges with a marginal portion of the flattened opening-defining edges protruding;

(c) moving the filled sacks from the take-over position to a closing position while maintaining the clamping of the flattened opening-defining edges and while moving the sack between said positions advancing the opening-defining edges relative to the clamping lengthwise of the sack, to protrude a greater marginal portion to facilitate closure; and (d) closing the sack at the closing position by forming a seam in the greater marginal portion protruded.

15. The method of claim 14 wherein the clamped flattened opening-defining edges lie in a horizontal plane in the take-over position and including the further step of rotating the flattened opening-defining edges to lie in a vertical plane at the closing position as the filled sack is moved from the take-over position to the closing position.

16. Apparatus for closing filled sacks, which have been transferred from a filling station to a closing station during which transfer the opening-defining edges of the filled sacks have been flattened together and held by gripper means comprising gripping roller means including a pair of rollers rotatably mounted about axes which are at right angles to the main axis of the sack for receiving and clamping said opening-defining edges when released by the gripper means in a take-over position, moving means for moving the sack and gripping roller means from a point at which said gripping roller means receives said flattened opening-defining edges to a second point where said flattened opening-defining edges are to be closed, closure means located at said second point to form a seam for closing the opening-defining edges of the sack, and operative means actuated responsive to moving said gripping roller means to cause rotation of at least one of the rollers of the gripping roller means to advance the gripped opening-defining edges out of the rollers a predetermined amount to present a greater margin at said second point for said closure means to act on wherein the moving means includes a carriage means in which the gripper roller means is mounted with the pair of rollers arranged vertically spaced, the lower roller in the take-over position being rotatably mounted in the carriage and the upper roller being freely rotatably mounted in a sub-frame which is pivoted about the axis of the lower roller, and the operative means includes lever means clamped to the shaft of the lower roller and connected to a stationary point in such a manner that the lower roller will be rotated as the carriage means moves to the second point.

* * * * *